United States Patent [19]

Arsuaga

[11] 4,391,469

[45] Jul. 5, 1983

[54] MINERAL MINING INSTALLATION

[75] Inventor: Yavier Arsuaga, Madrid, Spain

[73] Assignee: Gewerkschaft Eisenhutte Westfalia, Lunen, Fed. Rep. of Germany

[21] Appl. No.: 313,010

[22] Filed: Oct. 19, 1981

[30] Foreign Application Priority Data

Oct. 31, 1980 [DE] Fed. Rep. of Germany ..... 3041101

[51] Int. Cl.[3] ..... E21C 29/02; E21D 23/04

[52] U.S. Cl. ..... 299/11; 299/32; 299/33; 405/291

[58] Field of Search ..... 299/11, 31–33; 405/291–301

[56] References Cited

U.S. PATENT DOCUMENTS

| | | | |
|---|---|---|---|
| 3,504,944 | 4/1970 | Holz et al. | 299/32 |
| 3,677,603 | 7/1972 | Small | 299/31 |
| 3,861,749 | 1/1975 | Georg | 299/32 |
| 3,872,677 | 3/1975 | Linke et al. | 405/296 |

*Primary Examiner*—Ernest R. Purser
*Assistant Examiner*—Thuy M. Bui
*Attorney, Agent, or Firm*—Sughrue, Mion, Zinn, Macpeak and Seas

[57] ABSTRACT

A mineral mining installation is provided for use in a steeply-inclined longwall working. The installation comprises a ladder-shaped support frame, and a plurality of roof support units. The support frame extends along the entire length of the longwall working, and has a pair of generally parallel longitudinal beams interconnected by a plurality of transverse beams. The roof support units are positioned between the longitudinal beams, and are supported on the transverse beam. Each of the longitudinal beams comprises a plurality of beam sections pivotably connected together end-to-end. The support frame comprises a plurality of detachably connected sub-frames, each of which comprises a respective transverse beam and a respective beam section of each of the longitudinal beams.

31 Claims, 11 Drawing Figures

FIG.2
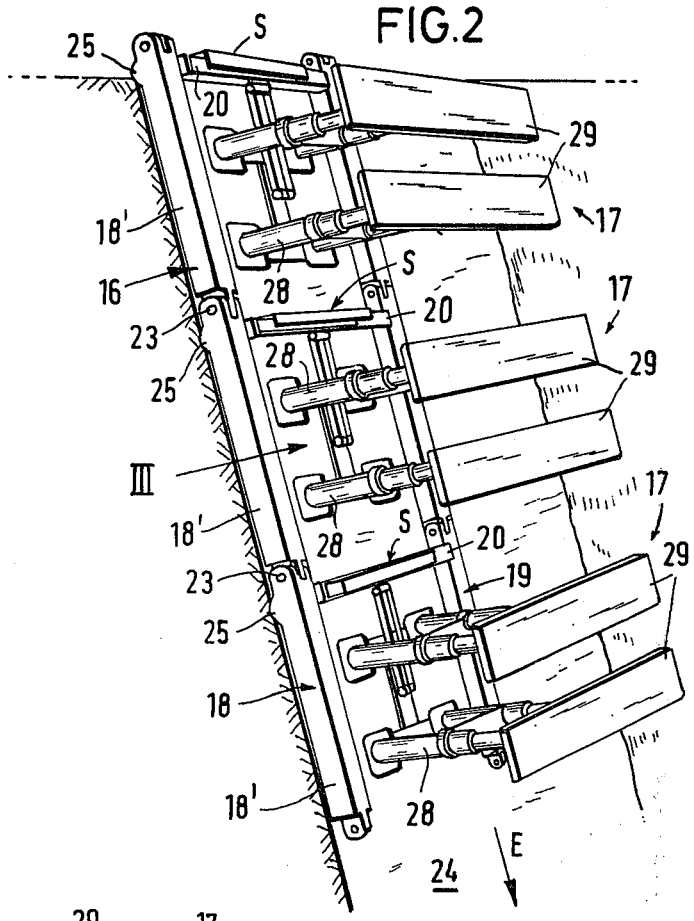
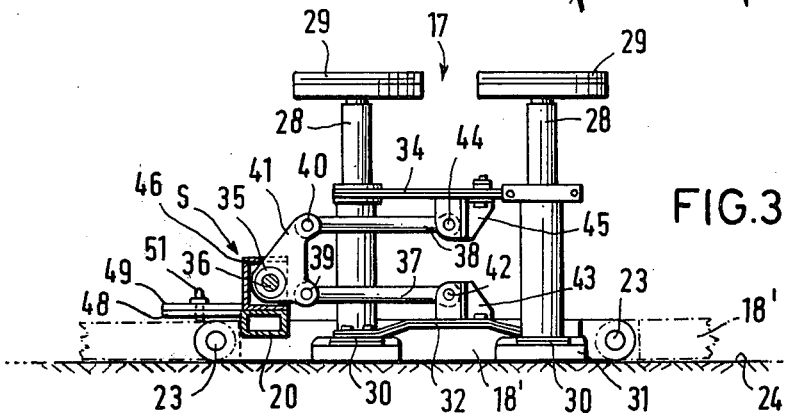
FIG.3

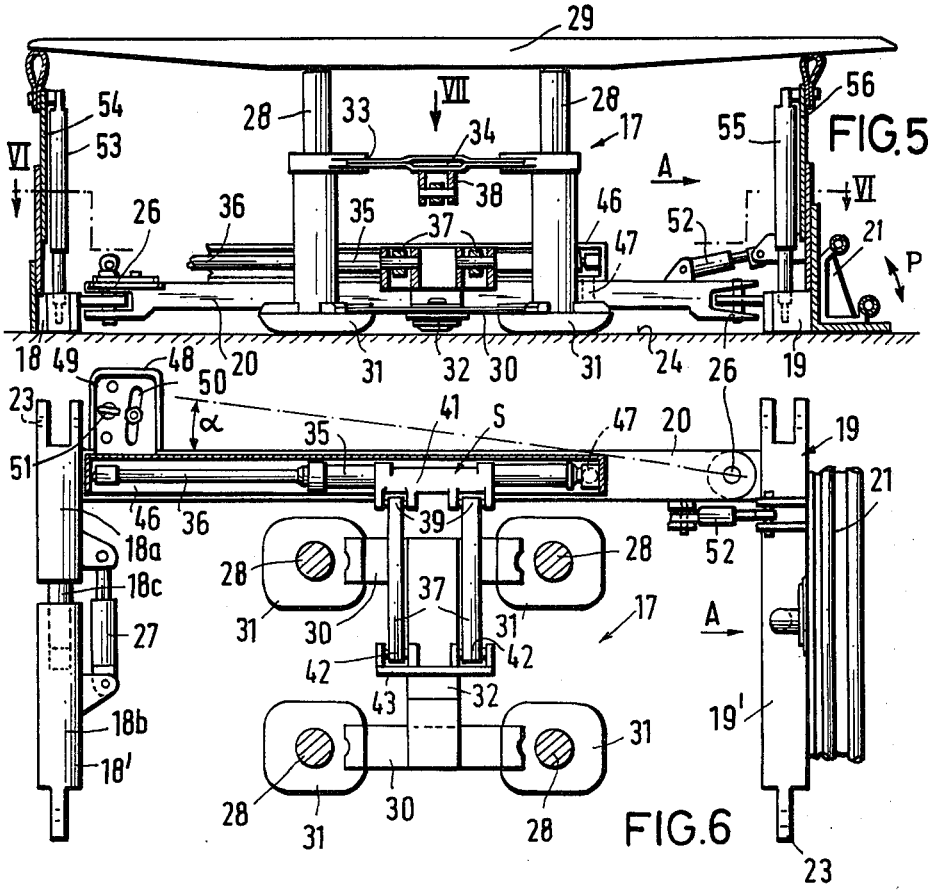
FIG.5
FIG.6
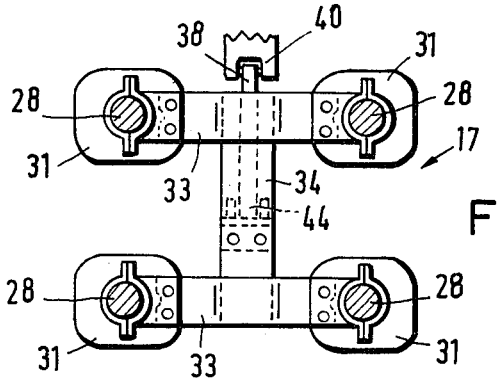
FIG.7

MINERAL MINING INSTALLATION

BACKGROUND TO THE INVENTION

This invention relates to a mineral mining installation for use in a steeply-inclined longwall working, and to a method of introducing a mineral mining installation into a steeply-inclined longwall working.

As is well known, the economical working of steeply-inclined coal seams gives rise to technical problems which have hitherto not been satisfactorily solved. The heavy roof support and winning installations, which have proved successful in winning mineral material in horizontal or moderately-inclined workings, cannot be successfully used in steeply-inclined workings because of the considerable forces associated with the steepness the incline. Moreover, in order to work steeply-inclined seams economically, it is essential that the roof support units can be introduced into, and removed from, the steeply-inclined working in a rapid manner, and this is not possible using the type of installation referred to above.

A known type of mineral mining installation for winning mineral material (such as coal) in a steeply-inclined working comprises a ladder-shaped support frame, a roof support assembly, and a winning machine (such as a plough) movable to and fro along the face-side of the roof support assembly. The support frame extends over the entire length of the longwall working, and is constituted by a pair of longitudinal beams (stringers) interconnected by a plurality of transverse beams (rungs). The face-side longitudinal beam forms a guide rail for a coal plough, and the goaf-side longitudinal beam supports a goaf screen. The transverse beams form part of the roof support units which constitute the roof support assembly, the transverse beams carring hydraulic props which support the roof of the working (see DE-PS No. 1 217 905). The main disadvantage of this type of installation is that it is relatively heavy and bulky. Moreover, as the face is won, the individual roof support units have to be removed from the bottom roadway and replaced at the top roadway.

Another known type of installation for use in steeply-inclined workings also has a ladder-shaped support frame. Here, the face-side longitudinal beam consists of a plurality of beam sections pivotably connected together, the face-side longitudinal beam again forming a guide rail for a winning machine (see DE-OS No. 1 608 278). The transverse beams, which interconnect the two longitudinal beams of the support frame, support and guide the roof bars and/or the floor sills of the roof support units. In this arrangement, each roof support unit is guided by transverse beams on both sides thereof. It is necessary, therefore, to provide either two or four transverse beams for each roof support unit. These transverse beams are interconnected, in pairs, by cross-pieces which support the advance mechanisms of the roof support units. Here again, this installation is relatively bulky and heavy, and considerable expenditure of time and effort is required for introducing it into a steeply-inclined longwall working.

The main object of the invention is to provide a mineral mining installation for use in a steeply-inclined longwall working which is of relatively simple construction, and which is relatively easy to introduce into, and remove from, such a working in a relatively rapid manner, so that the face of the working can be won economically. A further object of the invention is to provide an installation which utilises light-weight roof support units having only a moderate load-bearing capacity, and in which the operating forces that occur (and in particular the forces arising from the incline) are controlled in a reliable manner, so that the winning equipment associated with the installation can be readily adapted to different operating conditions. Another object of the invention is to provide a simple and economical method of introducing a mineral installation into a steeply-inclined longwall working.

SUMMARY OF THE INVENTION

The present invention provides a mineral mining installation for use in a steeply-inclined longwall working, the installation comprising a ladder-shaped support frame and a plurality of roof support units, the support frame extending along the longwall working and having a pair of generally parallel longitudinal beams interconnected by a plurality of transverse beams, the roof support units being positioned between the longitudinal beams and being supported on the transverse beams, each of the longitudinal beams comprising a plurality of beam sections pivotably connected together end-to-end, wherein the support frame comprises a plurality of detachably connected sub-frames, each of which comprises a respective transverse beam and a respective beam section of each of the longitudinal beams.

Thus, in this form of installation, the support frame (which can be of relatively light-weight construction and rests on the floor of the working) is constituted by a plurlity of separable sub-frames. Each of the sub-frames can be attached to a respective roof support unit, and introduced into the longwall working from the top roadway. Once positioned in the working, a given sub-frame can be attached to the previously-introduced sub-frame by means of rapid-action couplings. In this way, the entire installation can be rapidly introduced into the longwall working; and, after the seam has been completely worked, the installation can likewise be rapidly dismantled and removed. Thus, an important requirement for the economical working of steeply-inclined seams is met.

Advantageously, the installation further comprises a guide arranged at the face side of the working, and a mineral winning machine movable to and fro along the guide. Preferably, the mineral winning machine is a plough.

Conveniently, the beam sections of the longitudinal beams are connected together by pivot joints having transverse axes. This permits the support frame to accommodate any uneveness in the floor of the working.

In a preferred embodiment, the transverse beam of each sub-frame is connected to the beam sections of that sub-frame at first end portions of said beam sections. Alternatively, the transverse beam of each sub-frame is connected to the beam sections of that sub-frame at the middle portions of said beam sections.

Preferably, the transverse beam of each sub-frame is connected to the beam sections of that sub-frame by means of pivot joints whose axes extend at right-angles to said transverse beam and to said beam sections. This permits the support frame to adapt itself to the orientation of the longwall face. In particular, the support frame can be adjusted to deal with a face which is tilted.

Advantageously, a respective roof support unit is positioned between each pair of adjacent transverse beams, and each roof support unit is supported on the transverse beam at the upper side thereof. Preferably, each of the roof support units is provided with an advance mechanism, and each of the roof support units is connected to the respective upper transverse beam by means of its advance mechanism, whereby the roof support units are advanceable relative to the support frame towards the longwall face. This results in an installation of relatively simple construction in which the roof support units have a substantial freedom of movement in the direction of face advance. It also permits substantial adaptation of the installation to different working conditions.

Conveniently, at least one beam section of each longitudinal beam is of two-part construction, said two parts being telescopically interconnected. Preferably, each of said telescopic beam sections is provided with a hydraulic adjusting ram connected between its two parts. Advantageously, each of the transverse beams is spaced from the floor of the longwall working, each of the beam sections is provided with a downwardly-projecting floor-engaging skid, and the floor-engaging skids are provided adjacent to the upper ends of the beam sections. The telescopic beam sections permit differences in length resulting from the movements of the longitudinal beams to be off-set. They also facilitate the adaptation of the support frame to any unevenness in the floor of the working, and help avoid undesirable forces being applied to the support frame. Unwanted deformations of the support frame are, therefore, avoided.

It is advantageous, in steeply-inclined workings, to use roof support units of relatively light-weight construction and a moderate load-bearing capacity. In this case, each of the roof support units may be provided with a plurality of roof-supporting hydraulic props, the hydraulic props of each roof support unit being interconnected by resilient plate means both in the region of their bases and in the region of the upper ends of their cylinders, each of the resilient plate means being connected to the advance mechanism of that roof support unit by means of at least one linkage. Advantageously, each of said linkages is pivotably connected to the respective advance mechanism and to the respective resilient plate means by means of pivot joints whose axes extend towards the longwall face. Preferably, each of the roof support units has four hydraulic props which are disposed at the corners of a rectangle, and wherein each of the resilient plate means is of H-shaped configuration, the linkages being connected to the H-shaped resilient plate means at the centres of the bars of the H's.

Advantageously, the advance mechanism of each roof support unit is connected to the respective upper transverse beam in such a manner as to be angularly adjustable relative thereto. Preferably, the advance mechanism of each roof support unit includes a hydraulic advance ram having a piston rod which extends right through a cylinder, and wherein said linkages are connected to the cylinders of the hydraulic advance rams. In this case, the cylinder of each hydraulic advance ram may be supported on the associated transverse beam by means of an elongate carrier, and each of the carriers may be pivotably mounted on its transverse beam in such a manner as to be angularly adjustable relative thereto in a plane parallel to that of the floor of the longwall working. This enables the roof support units to be correctly aligned, during advance, by off-setting any tendency to slide down the incline. It also permits the entire row of roof support units (together with the support frame) to be adjusted to accommodate a tilted face.

Conveniently, means are provided for locking each of the carriers to its transverse beam at any angle thereto in a given range of angles. Advantageously, each of the carriers is of U-shaped cross-section and at least partially surrounds the cylinder of the associated advance ram. Thus, the carriers serve to protect the cylinders of the advance rams.

In a preferred embodiment, the guide is attached to the face-side longitudinal beam. The guide may be attached to the face-side longitudinal beam in such a manner as to be angularly adjustable relative thereto, and hydraulic adjusting rams may be provided for adjusting the angle of the guide relative to the face-side longitudinal beam. This enables the cutting horizon of the plough (or other winning machine) to be adjusted. Advantageously, the pivot joints connecting the beam sections of the face-side longitudinal beam to the transverse beams have a limited degree of movement in the plane perpendicular to that of the floor of the longwall working and that of the longwall face, and wherein said hydraulic adjusting rams are pivotably connected between the transverse beams and the beam sections of the face-side longitudinal beam. This adjustability of the face-side pivot joints facilitates the adjustability of the cutting horizon.

Preferably, each of the longitudinal beams is provided with an upwardly-extending screen whose height is adjustable.

The invention also provides a method of introducing a mineral mining installation into a steeply-inclined longwall working, the installation comprising a ladder-shaped support frame and a plurality of roof support units, the support frame having a pair of generally parallel longitudinal beams interconnected by a plurality of transverse beams, each of the longitudinal beams comprising a plurality of beam sections pivotably connected together end-to-end, and the support frame comprising a plurality of detachably connected sub-frames, each of which comprises a respective transverse beam and a respective beam section of each of the longitudinal beams, the method comprising the steps of coupling each of the roof support units to the transverse beam of a respective sub-frame in a roadway at the top of the longwall working, and introducing the sub-frames and attached roof support units into the longwall working in succession, wherein each time a sub-frame is introduced into the longwall working, its longitudinal beam sections are pivotably connected to the longitudinal beam sections of the previously-introduced sub-frame, and then the interconnected sub-frames and roof support units are lowered into the longwall working by a distance which corresponds to the length of one sub-frame.

Advantageously, said interconnected sub-frames and roof support units are lowered into the longwall working by lowering means which can be releasably attached to the support frame and is reciprocably movable in a direction parallel to that of the steeply-inclined longwall working.

In one preferred embodiment, the lowering means is situated in the top roadway and is constituted by a lifting carriage, the lifting carriage being reciprocably driven by hydraulic ram means, and being releasably attachable to each of the sub-frames as they are introduced into the longwall working. Alternatively, the lowering means comprises a pair of hydraulic rams mounted in the upper region of the longwall working adjacent to the floor thereof, said hydraulic rams being reciprocable in a direction parallel to that of the steeply-inclined longwall working, and being releasably attached to the interconnected sub-frames positioned in the longwall working.

BRIEF DESCRIPTION OF THE DRAWINGS

A mineral mining installation constructed in accordance with the invention will now be described, by way of example, with reference to the accompanying drawings, in which:

FIG. 2 is a perspective view of part of the installation of FIG. 1;

FIG. 3 is a view looking in the direction of the arrow III shown in FIG. 2;

FIG. 5 is a part-sectional side elevation of one of the roof support units of the installation of FIGS. 1 to 4;

FIG. 6 is a cross-section taken on the line VI—VI of FIG. 5;

FIG. 7 is a view looking in the direction of the arrow VII shown in FIG. 5;

DESCRIPTION OF PREFERRED EMBODIMENTS

Figure 1:
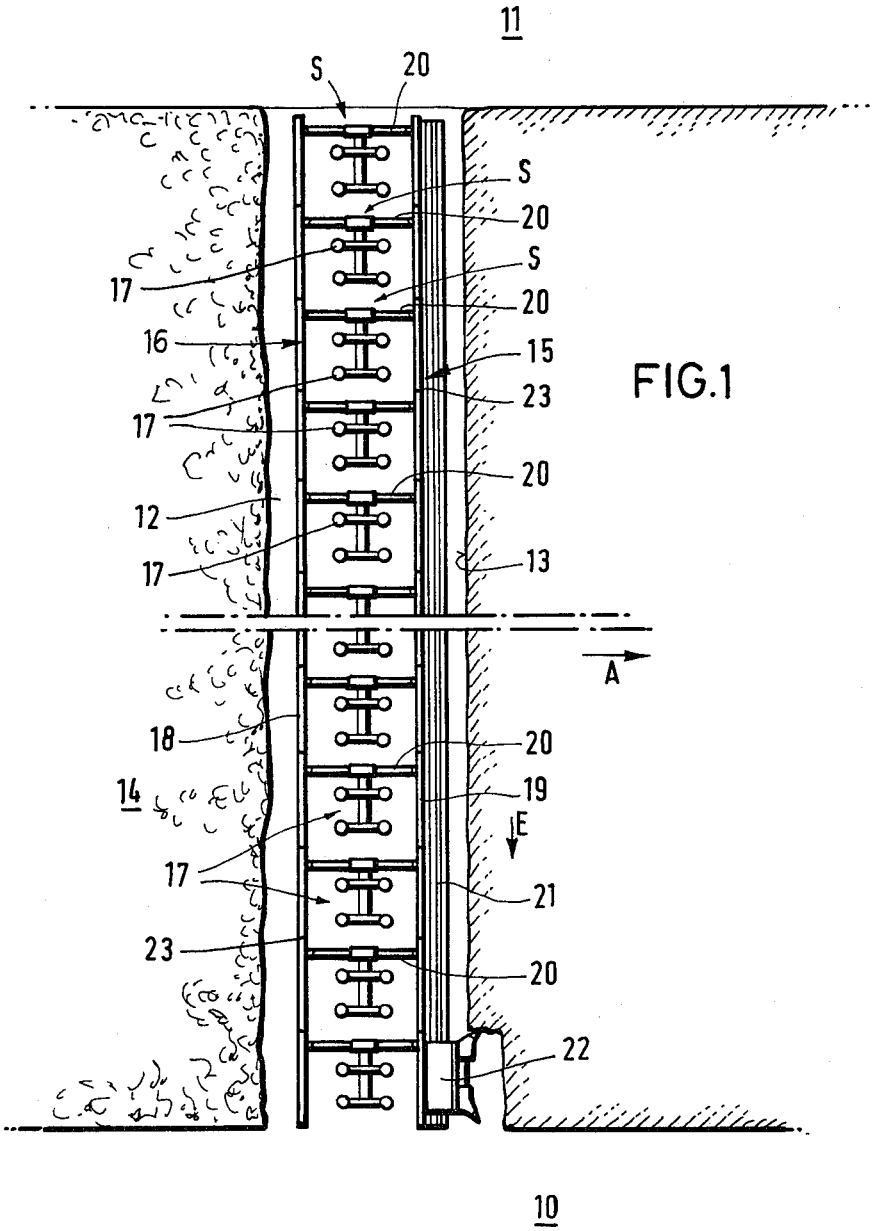
FIG. 1 is a diagrammatic plan view of the mineral mining installation positioned in a steeply-inclined longwall working.

Referring to the drawings, FIG. 1 shows a longwall working 12 which is downwardly inclined, in the direction of the arrow E, from a top roadway 11 to a bottom roadway 10. The longwall working 12 has a face 13 and a filled-in goaf side 14. The arrow A indicates the direction in which the face 13 is advanced as mineral material (such as coal) is won therefrom. A mineral mining installation 15 is located within the longwall working 12, the installation being constituted by a support frame 16 and a plurality of roof support units 17. The support frame 16 extends substantially the entire length of the longwall working 12; and the roof support units 17 are connected to, and guided on, the support frame.

The support frame 16 is of ladder-shaped configuration, having a pair of substantially parallel "stringers" 18 and 19 which are interconnected by a plurality of equispaced, rung-like, transverse beams 20. A respective roof support unit 17 is positioned between the beams 20 of each pair of adjacent beams. A guide 21 is provided on the face-side stringer 19, and a plough 22 is movable to and fro along the guide so as to win mineral material from the face 13. Alternatively, a shearer (or other winning machine) may be used instead of the plough 22.

Figure 4:
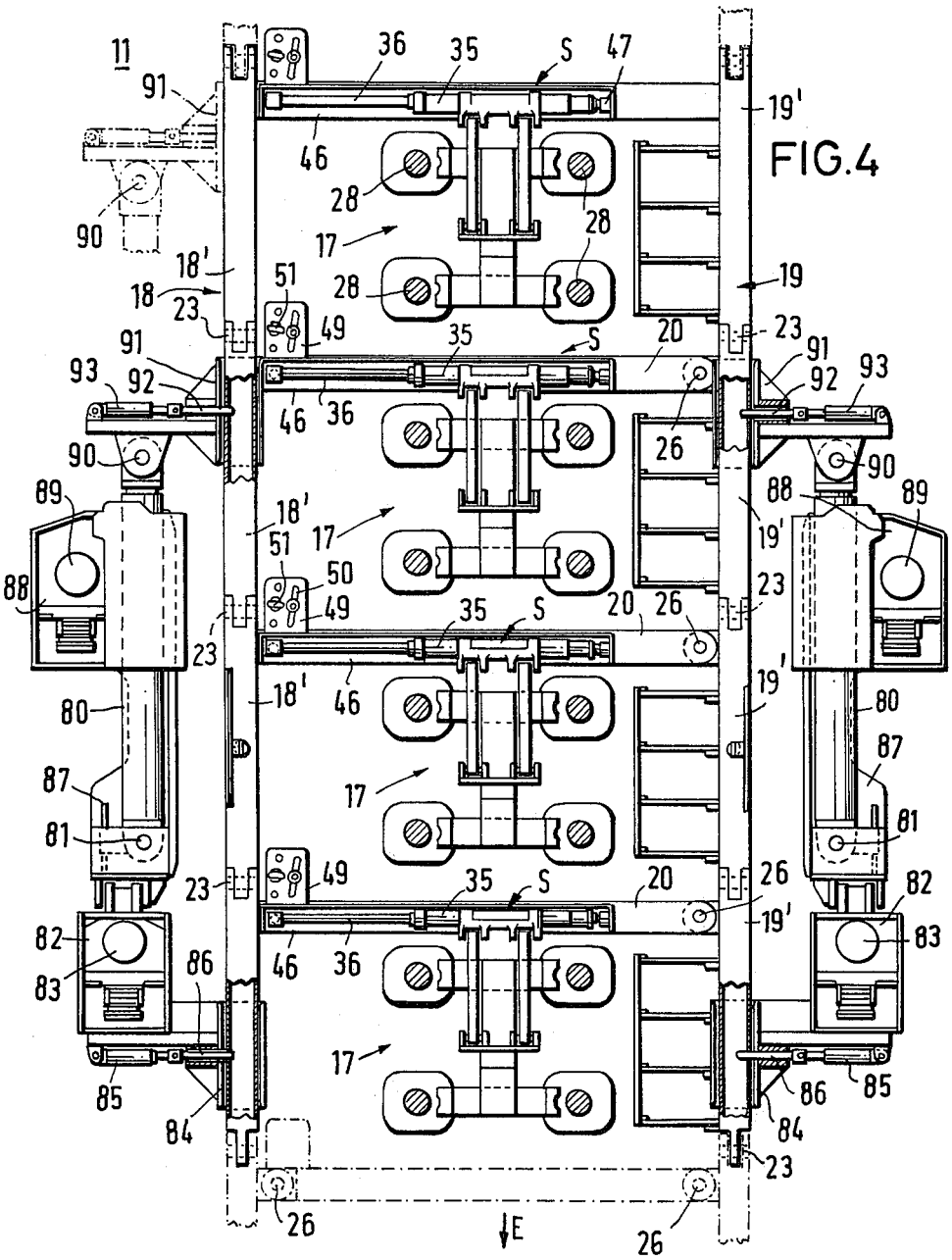
FIG. 4 is a partially cut-away plan view of part of the installation shown in FIGS. 1 to 3, and shows one arrangement for lowering the installation into the working.
Figure 8:
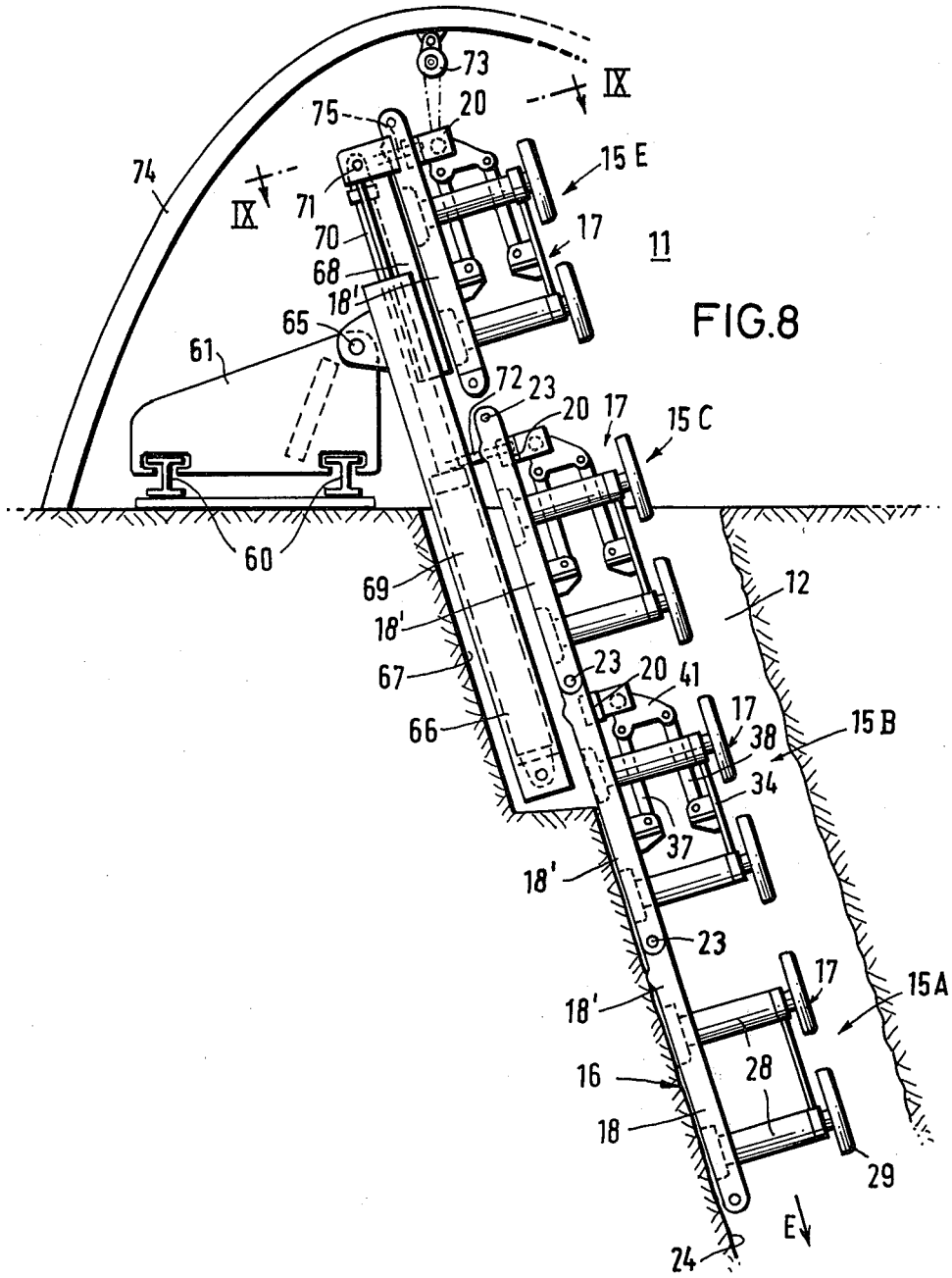
FIG. 8 is an elevation of the upper part of the installation, and shows another arrangement for lowering the installation into the working.

As best seen in FIGS. 2, 4 and 8, each of the stringers 18 and 19 is constituted by a plurality of individual sections 18' and 19' respectively. The length of each of the sections 18' and 19' is slightly greater than the width of each of the roof support units 17. The stringer sections 18' and 19' are pivotally connected together end-to-end by means of pivot joints 23 whose axes extend in the direction of the arrow A. Thus, the individual sections 18' and 19' of the two stringers 18 and 19 are relatively pivotable, so that the stringers can adapt themselves to any uneven regions of the floor of the longwall working 12. The lower face of each of the stringer sections 18' and 19' is provided with a respective downwardly-projecting floor skid 25 (see FIG. 2). The floor skids 25 are positioned adjacent to the upper ends of the stringer sections 18' and 19', so that the stringer sections are supported on the floor of the working 12 only in the regions of their upper ends.

The beams 20 interconnecting the stringers 18 and 19 are spaced apart by distances which correspond to the length of the individual stringer sections 18' and 19'. Each beam 20 is pivotably attached to an associated pair of stringer sections 18' and 19' by means of pivot joints 26 whose axes are substantially perpendicular to the plane of the floor of the longwall working 12. The pivot joints 26 permit the support frame 16 to adapt itself to different working conditions. In particular, the support frame 16 can be adjusted to accommodate a tilted face 13. In this case, the regions between adjacent pairs of beams 20 will be parallelograms rather than rectangles.

In order to enhance the adjustability of the support frame 16, some (say every third) of the stringer sections 18' and 19' are of telescopic construction. FIG. 6 shows the telescopic construction of the goaf-side stringer section 18' of one pair of stringer sections 18' and 19'. This section 18' is constituted by section parts **18*a* and 18*b*, the section part 18*a* having an extension 18*c* which is a sliding telescopic fit within the section part 18*b*. A hydraulic adjusting ram 27 pivotably links the two section parts 18*a* and 18*b*, the ram 27 being pivotably mounted on brackets fixed to the section parts. The ram 27 can, therefore, be used to vary the length of this goaf-side stringer section 18'**.

The ladder-shaped support frame 16 is, therefore, constructed like a double side-bar chain, the side-bars of which are constituted by the stringers 18 and 19. Each of the roof support units 17 is attached to the beam 20 which is located uphill thereof. Each roof support unit 17 is of light-weight construction, and has four hydraulic props 28 which are disposed in a rectangular arrangement. Each of the props 28 is mounted on a foot plate 31 which rests on the floor of the working 12. Each pair of props 28, which are arranged one behind the other in the direction A of face advance, support a common roof bar 29. Moreover, the foot plates 31 of the props 28 of each of these pairs are interconnected by means of a respective resilient plate 30. The middle portions of the two resilient plates 30 of each roof support unit 17 are interconnected, at right-angles thereto, by a further resilient plate 32. The resilient plates 30 and 32, which constitute leaf-spring connections, thus define a leaf-spring connection system of H-shaped form. This leaf-spring connection system 30,32 permits independent adjustments to be made to the props 28, so as to cater for uneven regions of the floor of the working 12. The upper ends of the props 28 of each roof support unit 17 are interconnected by a similar H-shaped leaf-spring connection system 33,34 (see FIGS. 3, 5 and 7).

Each of the roof support units 17 is suspended from its respective upper beam 20 by means of the advance mechanism S of that unit. Each advance mechanism S is constituted by a respective double-acting hydraulic advance ram 35 (see FIGS. 3, 4 and 6), whose piston rod 36 extends right through its cylinder. The cylinder of each ram 35 is attached to the associated roof support unit 17 by means of a pair of lower links 37 and an upper link 38. The links 37 of each lower pair are pivotably attached, by means of pivot pins 39, to a bracket 41 fixed to the cylinder of the associated ram 35. Similarly, each upper link 38 is pivotably attached, by means of a pivot pin 40, to the respective bracket 41. The axes of the pivot pins 39 and 40 extend substantially in the direction of a face advance. The other ends of the links 37 of each lower pair are pivotably attached, by means of pivot pins 42, to a bracket 43 fixed to the central region of the resilient plate 32 of the associated roof support unit 17. Similarly, the other end of each upper link 38 is pivotably attached, by means of a pivot pin 44, to a bracket 45 fixed to the central region of the resilient plate 34 of the associated roof support unit 17. This method of attaching the roof support units 17 to the cylinders of their advance rams 35 enables the roof support units to adapt themselves to uneven regions of the floor of the working 12. It also prevents the props 28 of the roof support units 17 from assuming inclined positions and from tilting in the direction E of dip. Moreover, the cylinders of the advance rams 35 can rotate relative to their piston rods 36, so that the roof support units 17 are supported from the beams 20 by means of rotatable connections. Obviously, the links 37 and 38 are subject to tension as they support the roof support units 17 beneath their respective beams 20.

Each of the advance mechanisms S is connected to its associated beam 20 in such a manner so as to be angularly adjustable in a plane parallel to that of the floor of the working 12. For this purpose, the cylinder of each advance ram 35 is mounted within a respective U-shaped carrier 46 which is mounted on the respective beam 20. The front (face-side) end of each carrier 46 is pivotably connected, by means of a respective pivot joint 47, to the respective beam 20. The front end of each of the piston rods 36 is also connected to the associated carrier 46 by means of the pivot joint 47 of that carrier. Each pivot joint 47 is such that the associated carrier 46 (together with its advance ram 35) can be pivoted, in a plane parallel to that of the floor of the working 12, relative to the associated beam 20. As shown in FIGS. 3 and 6, each beam 20 is provided with a plate 48 at its rear (goaf-side) end; and each carrier 46 is provided with a plate 49 at its rear end. Each plate 49 is arranged to overlie the plate 48 of the associated beam 20. Each pair of plates 48 and 49 are guided for relative pivotal movement by means of an arcuate guide 50; and the two plates can be fixed together, in any position within a given range of positions, by means of a push-in pin connector 51. In this way, each carrier 46 (together with its associated advance ram 35) can be pivoted away from the illustrated central position, in both directions relative to the associated beam, through a predetermined angle of say 3°. Since the advance rams 35 can be angled in this way, the roof support units 17 can be advanced in such a manner that they move up the incline slightly, so that any tendency they have to slip down the incline is offset. It is also possible to adjust the entire support frame 16 to accommodate a face 13 which is disposed at an angle to the direction E of dip.

The guide 21 is constituded by a plurality of guide sections (not shown) joined together end-to-end. In order to adjust the cutting level of the plough 22, the guide can be pivoted up and down, together with the stringer 19, about an axis extending in the longitudinal direction of the longwall working 12. For this purpose, the face-side pivot joints 26 are so designed that they have a limited degree of movement of the plane perpendicular to that of the floor of the working 12 and that of the face 13. Hydraulic adjustment rams 52 are pivotably mounted between the stringer 19 and each of the beams 20, the rams 52 being effective to control the angle of the guide 21 relative to the floor of the working 12 (as indicated by the double-headed arrow P shown in FIG. 5).

A telescopic goaf screen 54 is arranged on the goaf-side stringer 18 of the support frame 16, the height of the goaf screen being adjustable by means of hydraulic rams 53 (see FIG. 5). Thus, the goaf screen 54 can be adjusted to screen off the longwall working 12 from the goaf side 14, over the full height thereof, for workings of different heights. Similary, a telescopic face-side screen 56 is arranged on the face-side stringer 19, the height of the face-side screen being adjustable by means of hydraulic rams 55. Thus, the face-side screen 56 is effective to screen off the face 13 from the access area within the longwall working 12 over the entire height thereof.

The pivot joints 23, which interconnect the individual stringer sections 18' and 19', are easily-releasable, rapid-action pivot pin joints. Thus, the support frame 16 is constituted by a plurality of generally U-shaped sub-frames pivotably connected together; each of the sub-frames having a pair of stringer sections 18' and 19' connected together, by means of pivot joints 26, by a beam 20. Each sub-frame forms, together with the associated roof support unit 17 and advance mechanism S, forms a unit which can be introduced the longwall working 12 from the top roadway 11. As each unit is introduced, its sub-frame is connected to the sub-frame of the previously-introduced unit by means of the pivot joints 23.

Figure 9:
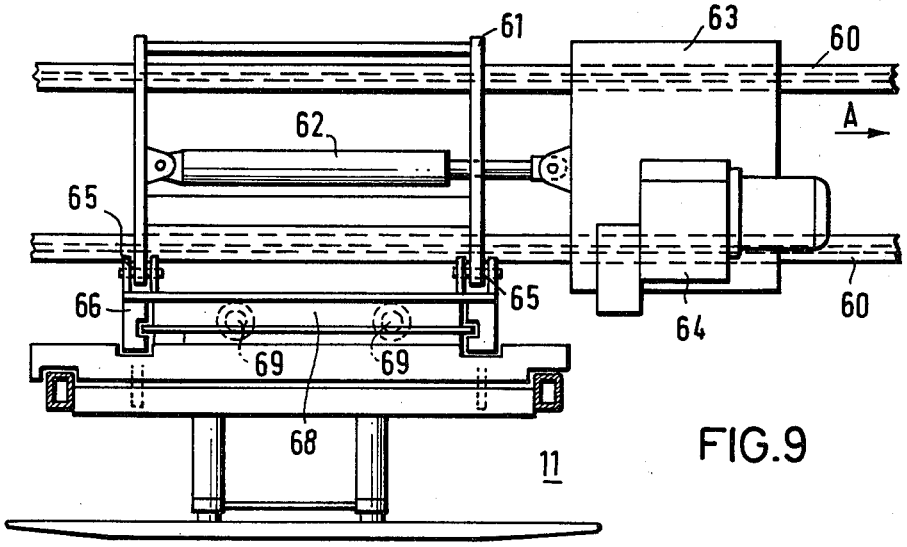
FIG. 9 is a view looking in the direction of the arrow IX shown in FIG. 8.

FIGS. 8 and 9 show an arrangement for introducing the above-mentioned units. A carriage 61 is provided in the top roadway 11, the carriage being movable along the roadway (that is to say in the direction A of face advance) on rails 60. A second carriage 63 is connected to the first-mentioned carriage 61 by means of a double-coating hydraulic ram 62. The second carriage 63 is also movable along the rails 60, and carries a drive 64 for the plough 22. The second carriage 63 is releasably secured within the top roadway 11 by means of anchoring devices (not shown).

A table 66 is pivotably mounted, by means of pivot pins 65, on the first carriage 61. The table 66 projects from the top roadway 11 into the upper region of the inclined longwall working 12, the table being accommodated within a shallow recess 67 formed in the floor of the working. A lifting carriage 68 is slidably mounted on the table 66. The lifting carriage 68 can be lowered, by means of hydraulic rams 69, from the raised position shown in FIG. 8 into the upper region of the longwall working 12. The hydraulic rams 69 are disposed within the table 66, and their piston rods 70 are pivotably connected to the lifting carriage 68 by means of pivot pins 71.

In the position shown in FIG. 8, three units 15A, 15B and 15C have already been introduced into the longwall working 12, and have been coupled together by means of their pivot joints 23. The interconnected units 15A, 15B and 15C are prevented from sliding down the inclined working 12 by connecting the uppermost unit 15C to the table 66. This is achieved by means of locking pins 72, which are displaceably mounted on the table 66, and which engage in apertures formed in the stringer sections 18' and 19' of the unit 15C. The locking pins 72 may be moved into, and out of, engagement with these apertures by, for example, hydraulic actuating rams (not shown).

The next unit (unit 15E) to be inserted into the longwall working 12 is positioned on the lifting carriage 68 by, for example, a block-and-tackle unit 73 which is attached to a roadway roof support arch 74. The unit 15E is secured to the lifting carriage 68 by means of locking pins 75, which are also actuable by means of hydraulic actuating rams (not shown). Once the unit 15E is secured to the lifting carriage 68 in the position shown in FIG. 8, the lifting carriage is lowered by retracting the lifting rams 69. The lifting carriage 68 is lowered until the lower ends of the stringer sections 18' and 19' of the unit 15E engage the upper ends of the stringer sections 18' and 19' of the unit 15C. The pins of the hinge joints 23 are then inserted to connect the stringer sections 18' and 19' of the two units 15C and 15E. As soon as this has been done, the locking pins 72 are released, and the interconnected units 15A, 15B, 15C and 15E are let down into the longwall working 12 by further lowering the lifting carriage 68. The lifting carriage 68 is lowered until the unit 15E assumes the position shown as occupied by the previously-inserted unit 15C in FIG. 8. The locking pins 72 are then re-positioned to lock the unit 15E to the table 66. The locking pins 75 are then released so that the lifting carriage 68 can be raised, by means of the lifting rams 69, into the position shown in FIG. 8, whereupon the further unit (not shown) can be positioned on the lifting carriage ready for introduction into the longwall working 12. As soon as the entire installation 15 has been positioned in the longwall working 12, the hydraulic props 28 of the roof support units 17 are extended into engagement with the roof of the working, and hence to secure the installation within the working. It will be understood that, prior to being introduced into the longwall working 12, each of the units 15A, 15B etc has been provided with a plough guide section, and with sections of the goaf screen 54 and the face-side screen 56.

Figure 10:
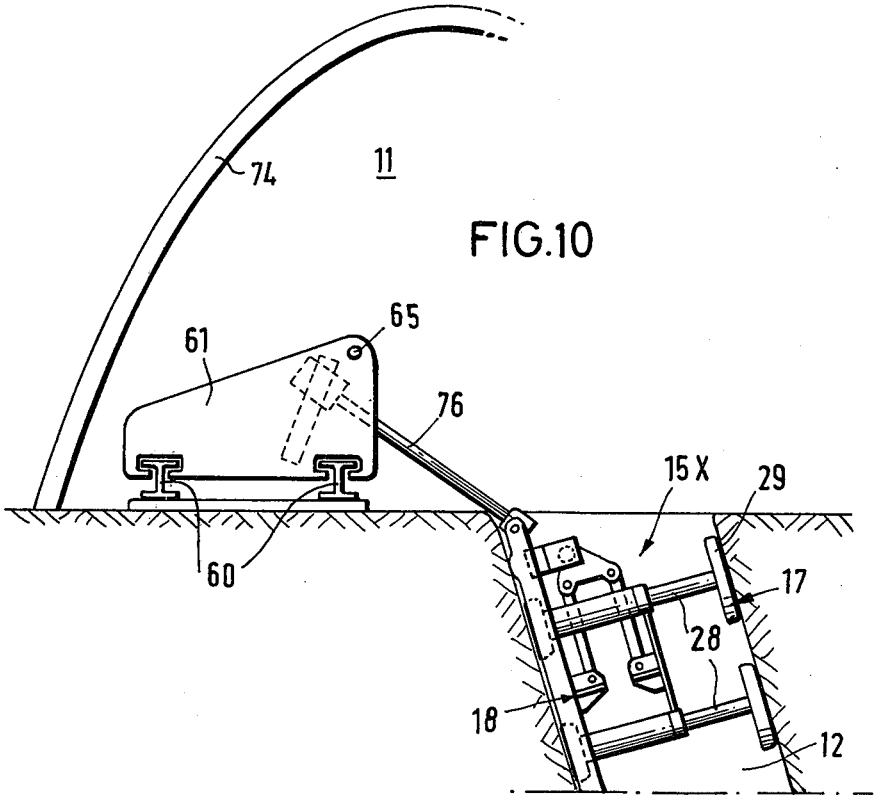
FIG. 10 is an elevation similar to that shown in FIG. 8, but showing the installation and said another lowering arrangement in the position in which the installation has been fully lowered into the working, and in which part of said another lowering arrangement has been removed.

As soon as the entire installation 15 has been secured within the longwall working 12 by extending the props 28 of the roof support units, 17 the table 66 and the lifting carriage 68 are removed from the carriage 61 be releasing the pivot joints 65. As shown in FIG. 10, the uppermost unit (15X) is then attached to the carriage 61 by means of a linkage 76. This linkage 76 helps prevent the installation sliding down the inclined working 12, though it is not essential and so can be dispensed with. The linkage 76 may be constituted by rods or chains.

In use, as the face 13 is advanced in the direction A, the installation 15 is advanced, to follow the face advance, by means of the advance mechanisms S. Thus, the roof support units 17 are first advanced by their advance rams 35. The support frame 16 is then advanced, in a follow-up step, by pressurising the advance rams 35 in the opposite direction. Similarly, the carriages 61 and 63 are moved along the rails 60, using the rams 62, to follow the advance of the face 13.

Figure 11:
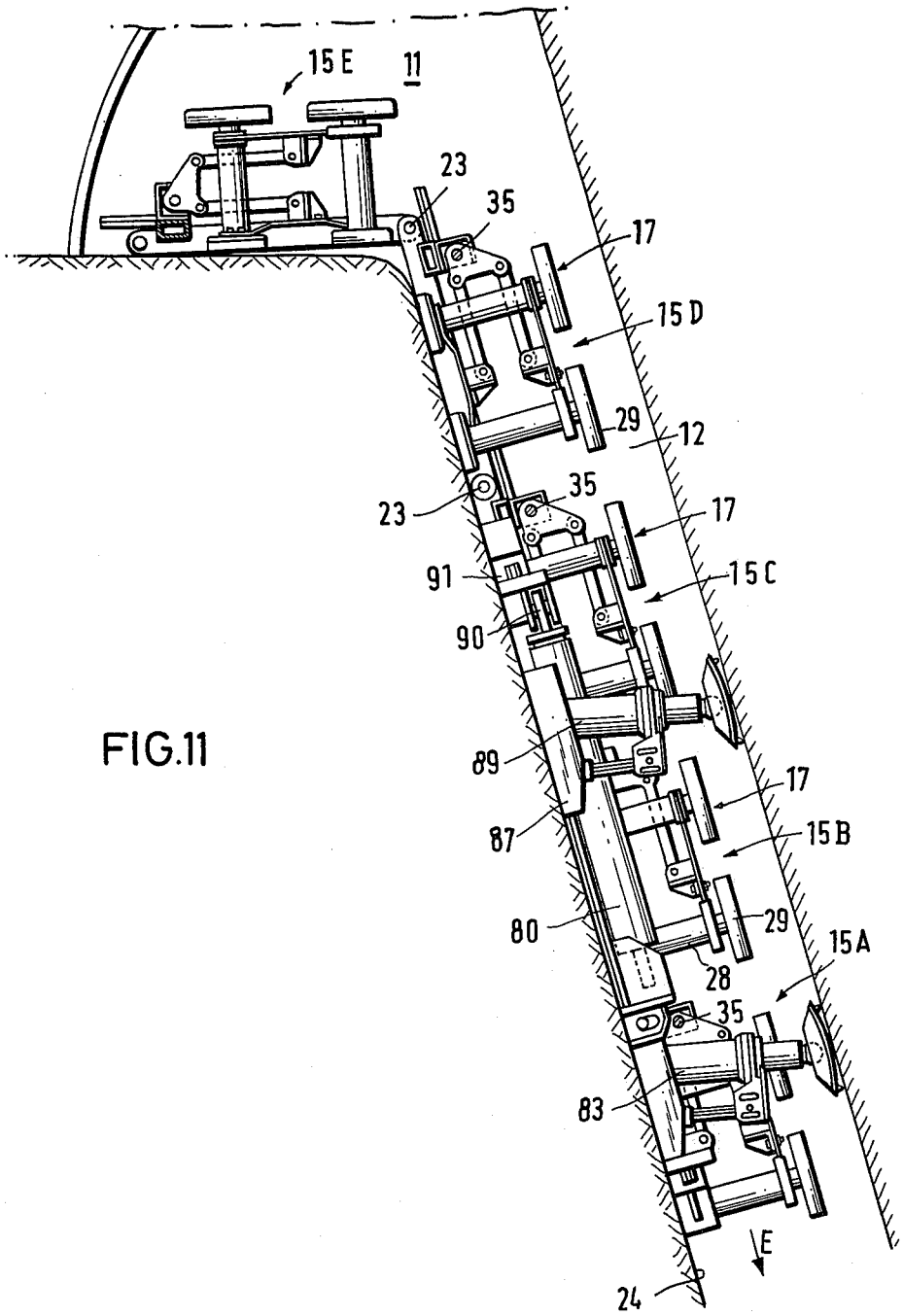
FIG. 11 is an elevation similar to that of FIG. 8, but showing said one lowering arrangement.

FIGS. 4 and 11 show another arrangement for introducing the units into the longwall working 12. This arrangement includes a pair of hydraulic lifting rams 80 positioned at the upper end of the longwall working 12, the lifting ram 80 being located at opposite sides of the installation 15. Each of the lifting rams 80 is attached to a respective anchoring device 82 by means of a respective pivot joint 81. The anchoring devices 82 can be braced between the roof and the floor of the working 12 by means of hydraulic anchoring props 83. Each of the anchoring devices 82 carries a slide skid 84, the stringers 18 and 19 of the support frame being slidably supported by the slide skids. The slide skids 84 are provided with locking pins 86 which are movable, by means of hydraulic actuating rams 85, into (and out of) engagement with apertures in the stringer sections 18' and 19'. The locking pins 86 can, therefore, be used to prevent the units already in the longwall working 12 from sliding down the working. Each of the anchoring devices 82 is connected to a respective further anchoring device 88, by means of a respective beam 87. The anchoring devices 88 can also be braced between the roof and the floor of the working 12 by means of hydraulic anchoring props 89. The piston rod of each of the lifting rams 80 is connected to a respective slide skid 91 by means of a respective pivot joint 90. The slide skids 91 also slidably support the stringers 18 and 19. The slide skids 91 are also provided with locking pins 92 which are movable, by means of hydraulic actuating rams 93, into (and out of) engagement with apertures in the stringer sections 18' and 19'. The locking pins 92 can, therefore, be used to lock the units already installed to the piston rods of the lifting rams 80.

In the position shown in FIG. 11, four units 15A, 15B, 15C and 15D have already been introduced into the longwall working 12, and have been coupled together by means of their pivot joints 23. In order to introduce a further unit 15E, this unit is positioned in the top roadway 11 and connected to the previously-introduced unit 15D by means of the pivot joints 23. The extended lifting rams 80 are locked to the stringer sections 18' and 19' of the unit 15C by means of the locking pins 92. The locking pins 86 are then released from the stringer sections 18' and 19' of the unit 15A, so that the interconnected units 15A, 15B, 15C, 15D and 15E can be lowered into the longwall working 12 by retracting the lifting rams 80. The locking pins 86 are then engaged with the stringer sections 18' and 19' of the unit 15B, and the locking pins 92 are released from the stringer sections 18' and 19' of the unit 15C. This enables the lifting rams 80 to be extended to that the locking pins 92 can be engaged with the stringer sections 18' and 19' of the unit 15D, and a further unit (not shown) can be positioned in the top roadway 11 ready to be connected to the unit 15E. As soon as the entire installation 15 has been positioned in the longwall working 12, the anchored there by extending the props 28 of the roof support units 17, the entire lowering arrangement can be returned to the top roadway 11.

The installation 15 is removable from the longwall working 12, using either of the arrangements described above, by reversing the procedure used for introduction.

In order to ensure that the roof support units 17 can be advanced in sufficiently large steps, the distance between the stringers 18 and 19 is chosen to be approximately twice the working stroke of the advance rams 35 of the advance mechanisms S. During advance, the roof support units 17 (whose props 28 are unpressurised) are guided on the beams 20.

It will be apparent that the installations described above could be modified in a number of ways. For example, instead of the support frame 16 being made up of a plurality of U-shaped sub-frames, it is possible to construct the support frame using H-shaped sub-frames. Each of the sub-frames would, in this case, have a pair of stringer sections 18' and 19' interconnected at their middles by means of a beam 20.

I claim:

1. A mineral mining installation for use in a steeply-inclined longwall working, the installation comprising a ladder-shaped support frame and a plurality of roof support units, the support frame extending along the longwall working and having a pair of generally parallel longitudinal beams interconnected by a plurality of transverse beams, the roof support units being positioned between the longitudinal beams and being supported on the transverse beams, each of the longitudinal beams comprising a plurality of beam sections pivotably connected together end-to-end, wherein the support frame comprises a plurality of detachably connected sub-frames, each of which comprises a respective transverse beam and a respective beam section of each of the longitudinal beams.

2. An installation according to claim 1, further comprising a guide arranged at the face side of the working, and mineral winning machine movable to and fro along the guide.

3. An installation according to claim 2, wherein the mineral winning machine is a plough.

4. An installation according to claim 2, wherein the guide is attached to the face-side longitudinal beam.

5. An installation according to claim 4, wherein the guide is attached to the face-side longitudinal beam in such a manner as to be angularly adjustable relative thereto, and wherein hydraulic adjusting rams are provided for adjusting the angle of the guide relative to the face-side longitudinal beam.

6. An installation according to claim 5, wherein the pivot joints connecting the beam sections of the face-side longitudinal beam to the transverse beams have a limited degree of movement in the plane perpendicular to that of the floor of the longwall working and that of the longwall face, and wherein said hydraulic adjusting rams are pivotably connected between the transverse beams and the beam sections of the face-side longitudinal beam.

7. An installation according to claim 1, wherein the beam sections of the longitudinal beams are connected together by pivot joints having transverse axes.

8. An installation according to claim 1, wherein the transverse beam of each sub-frame is connected to the beam sections of that sub-frame at first end portions of said beam sections.

9. An installation according to claim 1, wherein the transverse beam of each sub-frame is connected to the beam sections of that sub-frame at the middle portions of said beam sections.

10. An installation according to claim 1, wherein the transverse beam of each sub-frame is connected to the beam sections of that sub-frame by means of pivot joints whose axes extend at right-angles to said transverse beam and to said beam sections.

11. An installation according to claim 1, wherein at least one beam section of each longitudinal beam is of two-part construction, said two-parts being telescopically interconnected.

12. An installation according to claim 11, wherein each of said telescopic beam sections is provided with a hydraulic adjusting ram connected between its two parts.

13. An installation according to claim 1, wherein each of the transverse beams is spaced from the floor of the longwall working.

14. An installation according to claim 1, wherein each of the beam sections is provided with a downwardly-projecting floor-engaging skid.

15. An installation according to claim 14, wherein the floor-engaging skids are provided adjacent to the upper ends of the beam sections.

16. An installation according to claim 1, wherein each of the longitudinal beams is provided with an upwardly-extending screen whose height is adjustable.

17. An installation according to claim 1, wherein a respective roof support unit is positioned between each pair of adjacent transverse beams.

18. An installation according to claim 17, wherein each roof support unit is supported on the transverse beam at upper side thereof.

19. An installation according to claim 18, wherein each of the roof support units is provided with an advance mechanism, and each of the roof support units is connected to the respective upper transverse beam by means of its advance mechanism, whereby the roof support units are advanceable relative to the support frame towards the longwall face.

20. An installation according to claim 19, wherein the advance mechanism of each roof support unit is connected to the respective upper transverse beam in such a manner as to be angularly adjustable relative thereto.

21. An installation according to claim 19, wherein each of the roof support units is provided with a plurality of roof-supporting hydraulic props, and wherein the hydraulic props of each roof support unit are interconnected by resilient plate means both in the region of their bases and in the region of the upper ends of their cylinders, each of the resilient plate means being connected to the advance mechanism of that roof support unit by means of at least one linkage.

22. An installation according to claim 21, wherein each of said linkages is pivotally connected to the respective advance mechanism and to the respective resilient plate means by means of pivot joints whose axes extend towards the longwall face.

23. An installation according to claim 21, wherein each of the roof support units has four hydraulic props which are disposed at the corners of a rectangle, and wherein each of the resilient plate means is of H-shaped configuration, the linkages being connected to the H-shaped resilient plate means at the centres of the bars of the H's.

24. An installation according to claim 21, wherein the advance mechanism of each roof support unit includes a hydraulic advance ram having a piston rod which extends right through a cylinder, and wherein said linkages are connected to the cylinders of the hydraulic advance rams.

25. An installation according to claim 24, wherein the cylinder of each hydraulic advance ram is supported on the associated transverse beam by means of an elongate carrier, and wherein each of the carriers is pivotably mounted on its transverse beam in such a manner as to be angularly adjustable relative thereto in a plane parallel to that of the floor of the longwall working.

26. An installation according to claim 25, wherein means are provided for locking each of the carriers to its transverse beam at any angle thereto in a given range of angles.

27. An installation according to claim 25, wherein each of the carriers is of U-shaped cross-section and at least partially surrounds the cylinder of the associated advance ram.

28. A method of introducing a mineral mining installation into a steeply-inclined longwall working, the installation comprising a ladder-shaped support frame and a plurality of roof support units, the support frame having a pair of generally parallel longitudinal beams interconnected by a plurality of transverse beams, each of the longitudinal beams comprising a plurality of beam sections pivotably connected together end-to-end, and the support frame comprising a plurality of detachably connected sub-frames, each of which comprises a respective transverse beam and a respective beam section of each of the longitudinal beams, the method comprising the steps of coupling each of the roof support units to the transverse beam of a respective sub-frame in a roadway at the top of the longwall working, and introducing the sub-frames and attached roof support units into the longwall working in succession, wherein each time a sub-frame is introduced into the longwall working, its longitudinal beam sections are pivotably connected to the longitudinal beam sections of the previously-introduced sub-frame, and then the interconnected sub-frames and roof support units are lowered into the longwall working by a distance which corresponds to the length of one sub-frame.

29. A method according to claim 28, wherein said interconnected sub-frames and roof support units are lowered into the longwall working by lowering means which can be releasably attached to the support frame and is reciprocably movable in a direction parallel to that of the steeply-inclined longwall working.

30. A method according to claim 29, wherein the lowering means is situated in the top roadway and is constituted by a lifting carriage, the lifting carriage being reciprocably driven by hydraulic ram means, and being releasably attachable to each of the sub-frames as they are introduced into the longwall working.

31. A method according to claim 29, wherein the lowering means comprises a pair of hydraulic rams mounted in the upper region of the longwall working adjacent to the floor thereof, said hydraulic rams being reciprocable in a direction parallel to that of the steeply-inclined longwall working, and being releasably attachable to the interconnected sub-frames positioned in the longwall working.

* * * * *